US009405212B2

(12) United States Patent
Hanamoto et al.

(10) Patent No.: US 9,405,212 B2
(45) Date of Patent: Aug. 2, 2016

(54) IMAGE FORMING APPARATUS WITH MALFUNCTION DETECTION

(71) Applicant: CANON KABUSHIKI KAISHA, Tokyo (JP)

(72) Inventors: Hidetoshi Hanamoto, Mishima (JP); Kazutaka Yaguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/792,244

(22) Filed: Jul. 6, 2015

(65) Prior Publication Data

US 2016/0011536 A1 Jan. 14, 2016

(30) Foreign Application Priority Data

Jul. 11, 2014 (JP) ..... 2014-143577

(51) Int. Cl.

| | |
|---|---|
| ***B41J 2/385*** | (2006.01) |
| ***G03G 15/043*** | (2006.01) |
| ***G03G 15/00*** | (2006.01) |

(52) U.S. Cl.

CPC ..... *G03G 15/043* (2013.01); *G03G 15/5037* (2013.01); *G03G 15/55* (2013.01)

(58) Field of Classification Search

CPC ..... G03G 15/041; G03G 15/0415

See application file for complete search history.

(56) References Cited

U.S. PATENT DOCUMENTS

| | | | | |
|---|---|---|---|---|
| 6,204,870 | B1 * | 3/2001 | Nakagawa | B41J 2/473 347/133 |
| 2009/0087207 | A1 | 4/2009 | Iida et al. | 399/74 |
| 2013/0258032 | A1 * | 10/2013 | Ogasawara | G02B 26/10 347/224 |

FOREIGN PATENT DOCUMENTS

| | | | |
|---|---|---|---|
| JP | H04-240866 | | 8/1992 |
| JP | 2002244497 | A * | 8/2002 |
| JP | 2006-310876 | | 11/2006 |
| JP | 2009-042361 | | 2/2009 |
| JP | 2012-155075 | | 8/2012 |

OTHER PUBLICATIONS

JP_2002244497_A_T Machine Translation, Japan, Kato et al., Aug. 2002.*

* cited by examiner

*Primary Examiner* — Clayton E LaBalle
*Assistant Examiner* — Victor Verbitsky
(74) *Attorney, Agent, or Firm* — Fitzpatrick, Cella, Harper & Scinto

(57) ABSTRACT

An object is to accurately determine a factor that drops the quantity of laser light. An image forming apparatus is provided, which has: a laser diode that includes a front side emission point to which drive current is supplied and from which rear light is emitted; a photosensitive drum to which the rear light is emitted; a detection portion that detects a value on a surface potential of the photosensitive drum; and a determination portion that determines an abnormality of the laser diode, and the detection portion detects, a plurality of times, a value on the surface potential of a portion of the photosensitive drum to which the rear light is emitted, and the determination portion determines whether the laser diode is abnormal based on a change amount of the value on the surface potential detected by the detection portion.

12 Claims, 11 Drawing Sheets

IMAGE FORMING APPARATUS WITH MALFUNCTION DETECTION

BACKGROUND OF THE INVENTION

1. Field of the Invention

The present invention relates to an image forming apparatus.

2. Description of the Related Art

One problem of an image forming apparatus is that the surface potential of a photosensitive drum (photoreceptor) changes due to various factors, which results in a drop in image quality. For example, if the quantity of laser light emitted from a scanner unit drops, the surface potential of the photosensitive drum may become lower than a desired potential, whereby image quality deteriorates. Here a technique to detect the drop in quantity of laser light based on a transfer current amount is known (Japanese Patent Application Laid-Open No. 2012-155075).

Various factors may cause a drop in the quantity of the laser light. For example, if the image forming apparatus is continuously used in air in which such micro-foreign matter as dust and chemical substances are floating, the foreign matter enters the apparatus main body and adheres to the laser light source and other optical components inside the scanner unit. The deposition of dust on the surface of such optical components as a reflection mirror and an imaging lens of the scanner unit causes a gradual drop in reflectance and transmittance, whereby the quantity of laser light emitted from the scanner unit drops. On the other hand, if foreign matter adheres to an emission point of a laser element, such as a laser diode, the quantity of laser light drops dramatically. Therefore a technique to accurately determine a factor that causes a drop in the quantity of laser light is demanded.

With the foregoing in view, it is an object of the present invention to accurately determine a factor that causes a drop in the quantity of laser light.

SUMMARY OF THE INVENTION

To achieve the above object, an image forming apparatus according to the present invention has:

a light emitting member that includes a first emission portion to which drive current is supplied and from which first laser light is emitted;

a photoreceptor to which the first laser light is emitted;

a detection portion that detects a value on a surface potential of the photoreceptor; and a determination portion that determines an abnormality of the light emitting member, wherein the detection portion detects, a plurality of times, a value on the surface potential of a portion of the photoreceptor to which the first laser light is emitted, and the determination portion determines whether the light emitting member is in an abnormal state, based on a change amount of the value on the surface potential detected by the detection portion.

To achieve the above object, an image forming apparatus according to the present invention has:

a first light emitting member that includes a first emission portion emitting first laser light and a second emission portion emitting second laser light, and that emits the first laser light and the second laser light by supply of a common first drive current;

a second light emitting member that includes a third emission portion emitting third laser light and a fourth emission portion emitting fourth laser light, and that emits the third laser light and the fourth laser light by supply of a common second drive current;

a photoreceptor to which the first laser light and the third laser light are emitted;

a light receiving portion that receives the second laser light and the fourth laser light;

a light quantity control portion that controls a light quantity of the first laser light, which is emitted to the photoreceptor, based on the light quantity of the second laser light received by the light receiving portion, and controls a light quantity of the third laser light, which is emitted to the photoreceptor, based on the light quantity of the fourth laser light received by the light receiving portion;

a detection portion that detects a value on a first surface potential of a portion of the photoreceptor to which the first laser light is emitted, and a value on a second surface potential of a portion of the photoreceptor to which the third laser light is emitted; and a determination portion that determines an abnormality of the light emitting member, wherein the determination portion determines that the light emitting member is in an abnormal state when only one of the value on the first surface potential and the value on the second surface potential, detected by the detection portion, is a first predetermined value or more, and also determines that the light emitting member is in an abnormal state when only one of the value on the first surface potential and the value on the second surface potential, detected by the detection portion, is a second predetermined value or less.

Further features of the present invention will become apparent from the following description of exemplary embodiments (with reference to the attached drawings).

DESCRIPTION OF THE EMBODIMENTS

Embodiments of the present invention will now be described in detail based on examples with reference to the drawings. The dimensions, materials, shapes and relative dispositions or the like of the components described in the embodiments may need to be appropriately changed depending on the configuration and various conditions of the apparatus to which the present invention is applied. In other words, the scope of the invention is not limited to the following embodiments.

Figure 1:
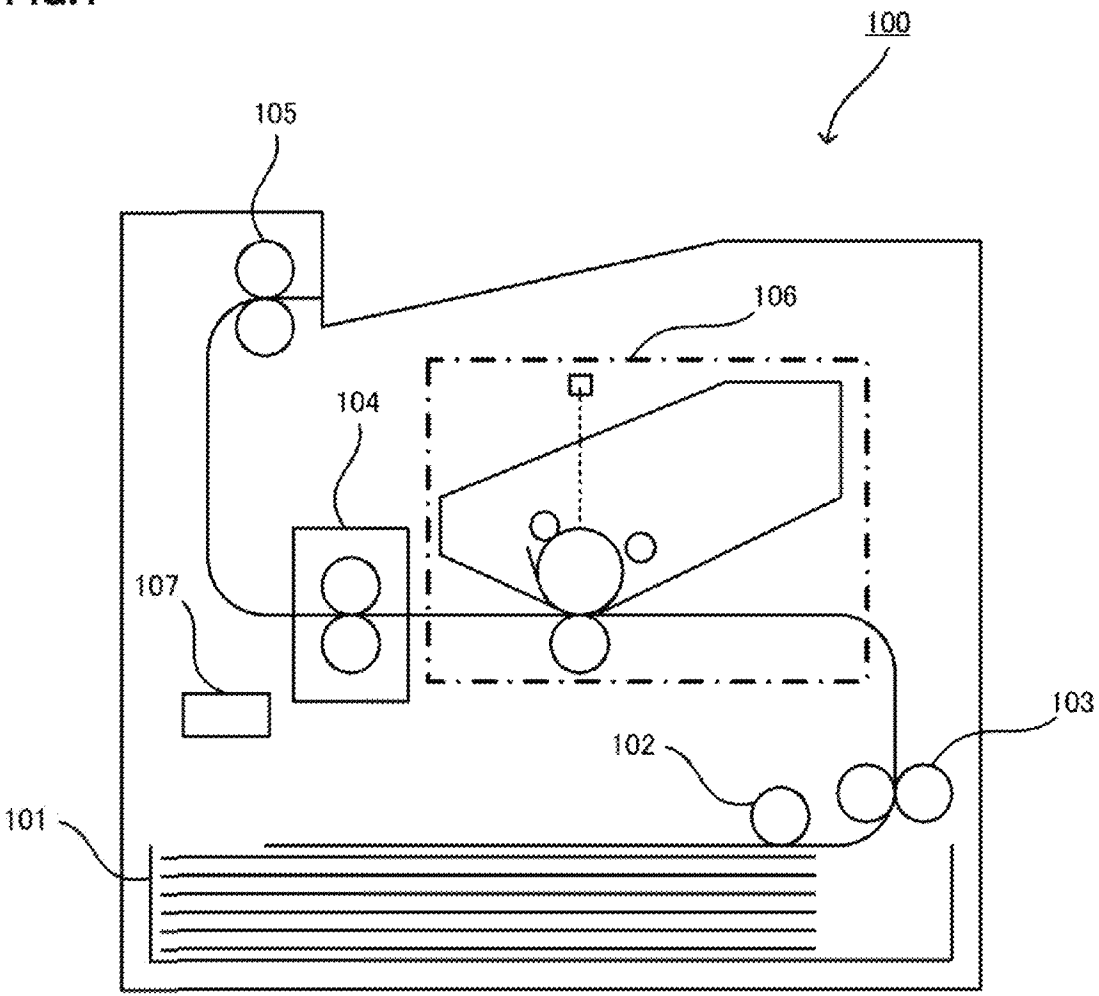
FIG. 1 is a cross-sectional view depicting a general configuration of an image forming apparatus according to this example.

With reference to FIG. 1, a general configuration of an image forming apparatus according to an example of the present invention (hereafter called "this example") will be described first. FIG. 1 is a cross-sectional view depicting a general configuration of the image forming apparatus according to this example. In this example, an electrophotographic laser beam printer will be described as an example of the image forming apparatus.

The image forming apparatus 100 includes a paper feeding cassette 101 where recording sheets are set, a pick up roller 102 that picks up paper, a paper feeding roller 103 that feeds and transports paper, a fixing apparatus 104 that fixes a toner image on paper, and a paper ejecting roller 105 that ejects paper. The image forming apparatus 100 also includes an image forming process portion 106 that performs charging, exposure, development, transfer or the like.

Paper that is set in the paper feeding cassette 101 is picked up by the pick up roller 102, and is fed and transported by the paper feeding roller 103. Then the toner image is transferred to the paper in the image forming process portion 106, and the toner image is fixed on the paper by the fixing apparatus 104. Then [the paper] is ejected from the image forming apparatus 100 by the paper ejecting roller 105.

Figure 2:
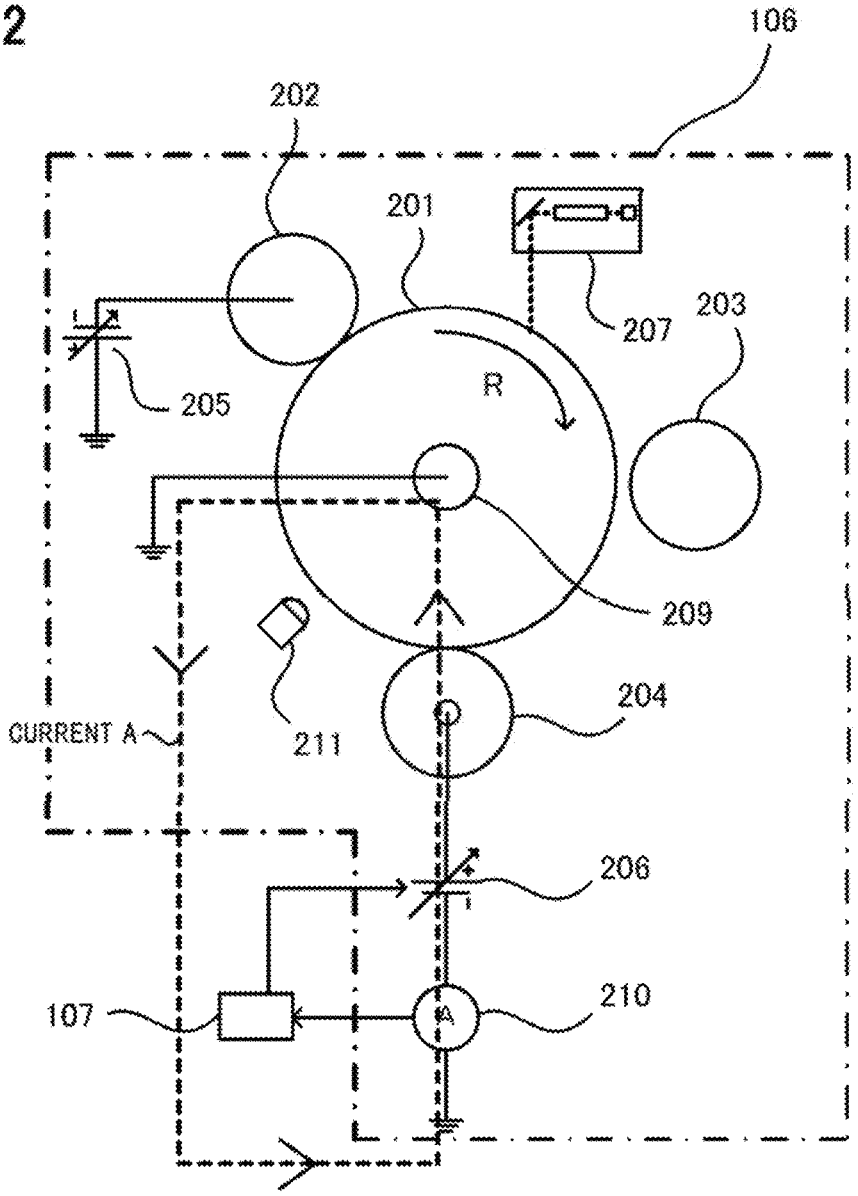
FIG. 2 is a schematic diagram depicting a configuration of an image forming processing unit of this example.

Now, details on the image forming process portion 106 will be described with reference to FIG. 2. FIG. 2 is a schematic diagram depicting the configuration of the image forming process portion of this example. The image forming process portion 106 includes a photosensitive drum 201 as an image bearing member, a charging roller 202, a developing sleeve 203, a transfer roller 204, a charging circuit 205, a transfer circuit 206, a scanner unit 207 and a pre-exposure portion 211.

A transfer bias generated by the transfer circuit 206 (voltage applying portion) is applied to the transfer roller 204. The transfer circuit 206 can change the output bias value and polarity to positive/negative by the control portion 107 that controls the operation sequence of the image forming apparatus. The current detection circuit 210 can detect current A that flows from the transfer circuit 206 to the transfer roller 204, the photosensitive drum 201, and a drum earth 209.

In the non-image area, the control portion 107 detects information acquired by the current detection circuit 210 when DC voltage is applied to the transfer roller 204. The control portion 107 determines the discharge start voltage between the photosensitive drum 201 and the transfer roller 204 based on each of the detected current values, and calculates the surface potential VL on the photosensitive drum 201 (hereafter called "drum potential VL") using the determination result. The image forming process, including the charging of the photosensitive drum 201, exposure to light by the scanner unit 207 or the like using the above procedure, is controlled by the control portion 107 that controls the image forming apparatus constituted by a CPU, ASIC or the like.

<Scanner Unit>

Figure 3:
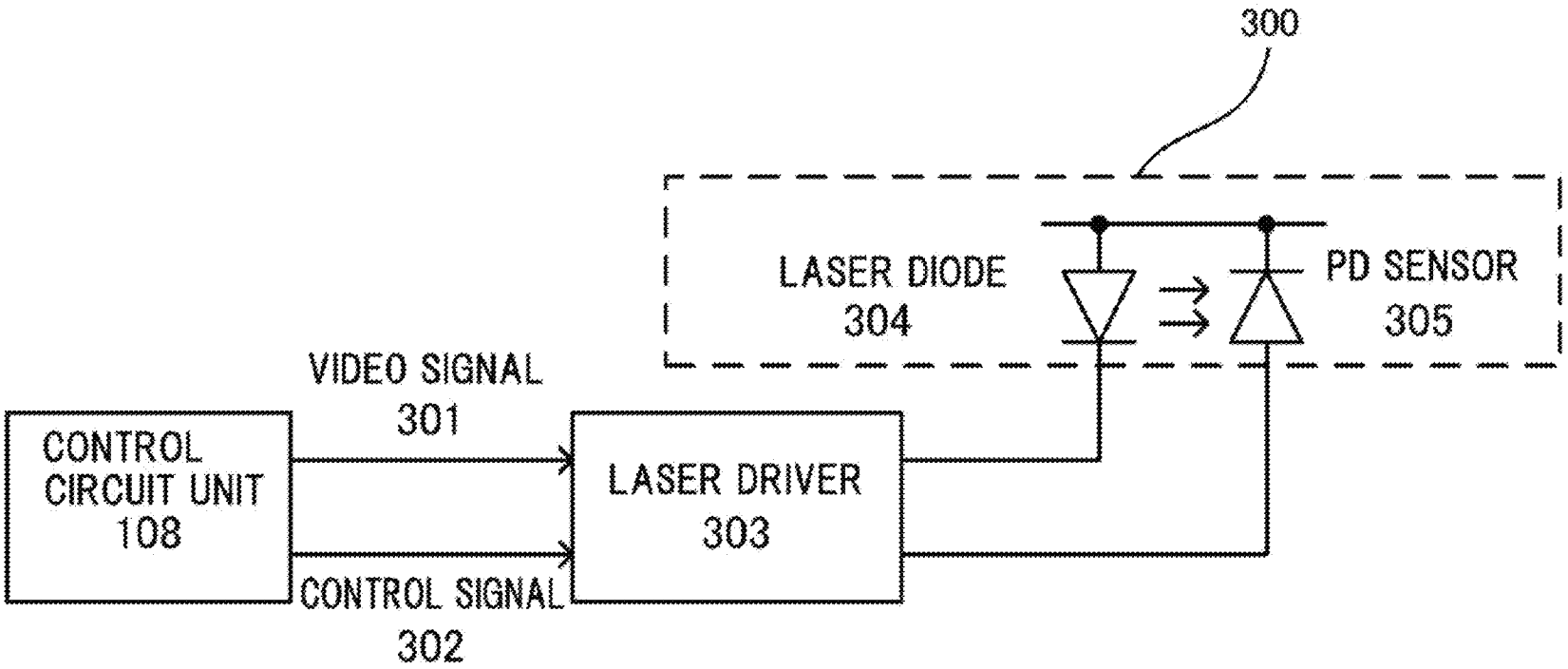
FIG. 3 is a block diagram depicting a light quantity control portion.
Figure 4:
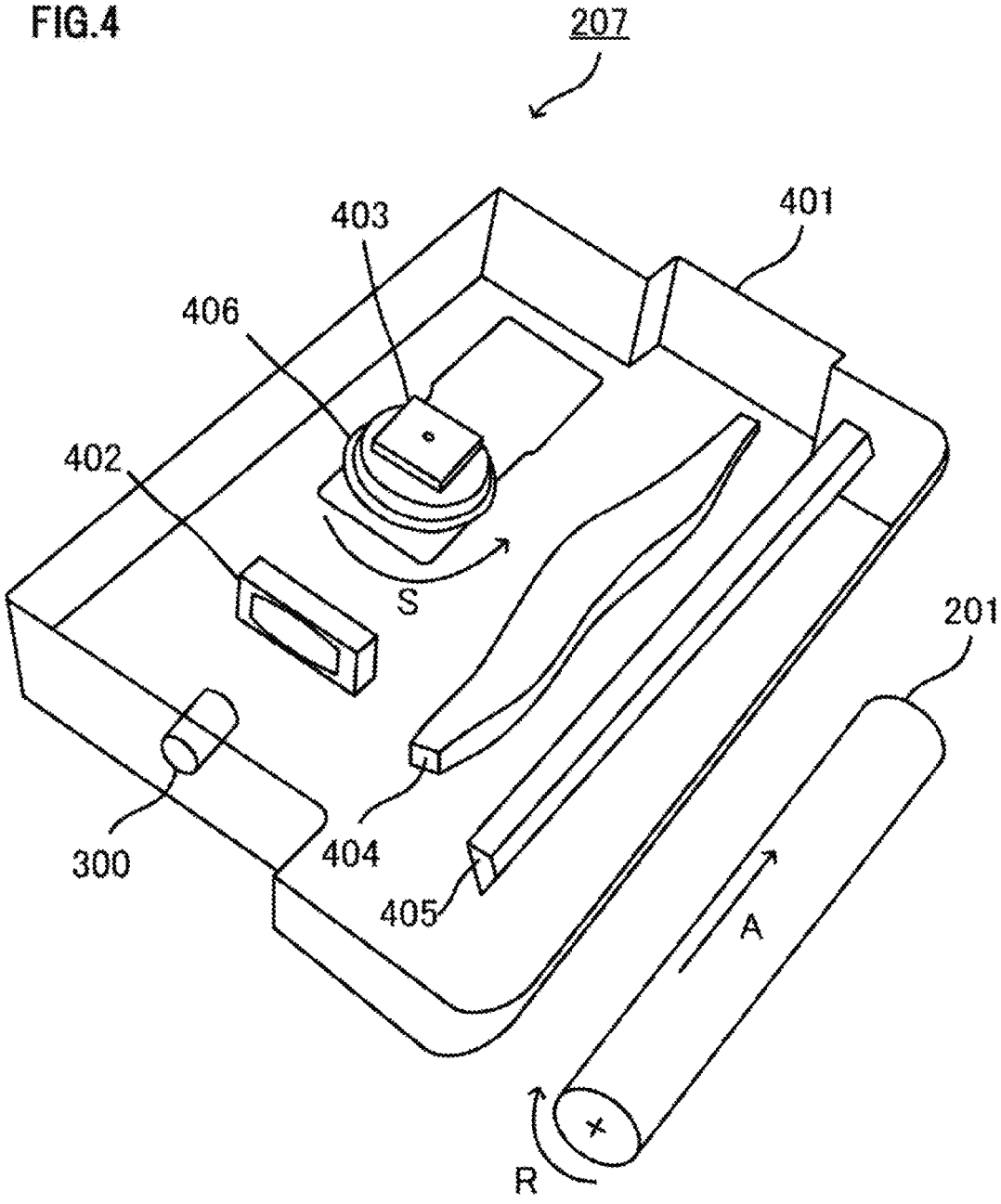
FIG. 4 is a perspective view depicting a configuration of a scanner unit.

Now the scanner unit of this example will be described with reference to FIG. 3 and FIG. 4. FIG. 3 is a block diagram depicting a light quantity control portion of the scanner unit that controls the exposure amount of the laser light source. FIG. 4 is a perspective view depicting the configuration of the scanner unit. The light quantity control portion of the present invention includes a laser driver 303 and the control circuit portion 108 shown in FIG. 3. As shown in FIG. 3, the laser driver 303 controls the light quantity to be constant while monitoring the light emitting quantity of the laser diode 304 using a PD (photo diode) sensor 305 (light receiving portion). The laser diode 304 is driven by the laser driver 303 in accordance with a video signal 301 from the control circuit portion 108 and a control signal 302 from the control circuit portion 108, and emits beams (laser light).

As shown in FIG. 4, the scanner unit 207 includes a laser light source 300 that has a laser diode 304 (see FIGS. 5A to 5C) which is a light emitting member, a cylindrical lens 402, a polygon mirror 403, an imaging lens 404, and a reflection mirror 405. Each optical component is housed in an optical case 401. The laser light emitted from the laser diode 304 in the laser light source 300 is collected by the cylindrical lens 402 to be a linear beam. The polygon mirror 403 is an example of a rotating polygon mirror, and is rotated in a predetermined direction (arrow S direction) by a scanner motor 406 so as to reflect the laser light during scanning. The scan motor 406 is controlled at a predetermined rotation speed by an acceleration signal/deceleration signal from a speed control portion (not illustrated).

The imaging lens 404 is designed to scan the photosensitive drum 201 at a constant speed, and the laser light reflected by the reflection mirror 405 forms a spot on the photosensitive drum 201 and scans in the arrow A direction. By the photosensitive drum 201 rotating in the arrow R direction, an electrostatic latent image is formed on the photosensitive drum 201.

If the image forming apparatus 100 is continuously used in air where micro dust and chemical substances are floating, the dust and chemical substances enter the main body of the image forming apparatus 100. Although the scanner unit 207 is located inside the image forming apparatus 100, the micro dust and chemical substances adhere to the optical components or the like inside the scanner unit 207 via an air duct that cools inside the image forming apparatus 100 or the like. If dust is deposited on the surfaces of the reflection mirror 405 and the imaging lens 404, for example, reflectance and transmittance gradually drop.

EXAMPLE 1

Figure 5A:
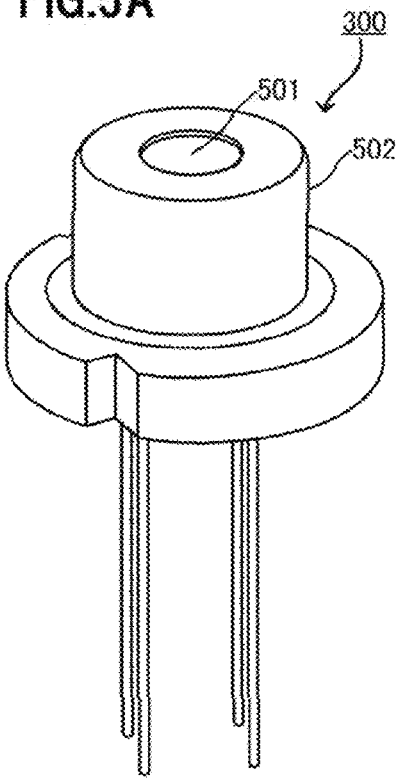
FIGS. 5A to 5C are diagrams depicting a configuration when a laser light source is packaged in a can package.
Figure 5B:
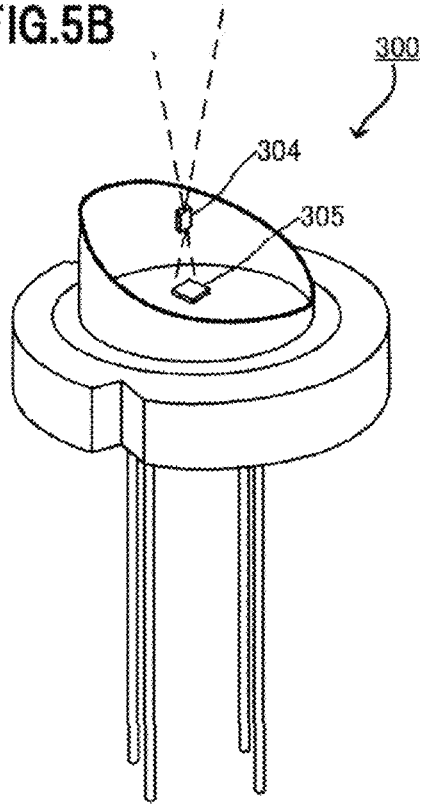
Figure 5C:
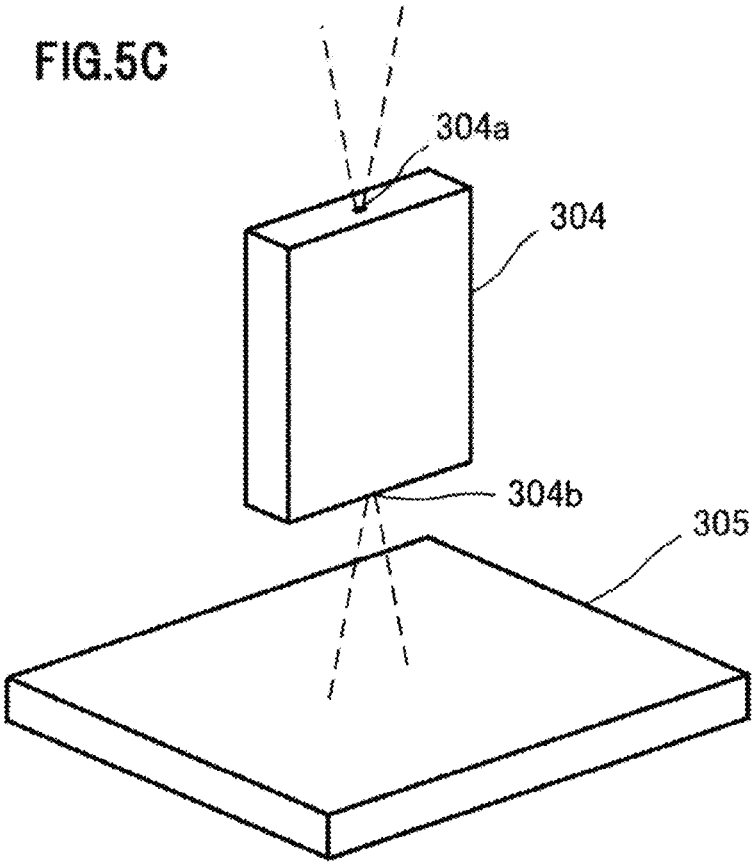

Example 1 of the present invention will now be described. A package of the laser light source according to Example 1 will be described with reference to FIGS. 5A to 5C. A can package or a frame package is normally used as a package of the laser light source 300 used for the image forming apparatus 100. FIGS. 5A to 5C are diagrams depicting a configuration when the laser light source is packaged using a can package. FIG. 5A is a diagram depicting a can package. FIG. 5B is a diagram depicting a laser light source and a PD sensor, where a part of FIG. 5A is omitted. FIG. 5C is an enlarged view of the laser light source and the PD sensor.

In the can package, the laser diode 304 is mounted on a stem (not illustrated), and is sealed by a metal can 502 on which a glass 501 is adhered. Some can packages are open packages which are not sealed and are without glass 501. In this case, the laser diode 304 is exposed to air.

In this example, a laser light quantity abnormality determination, in the case of using the laser light source 300 in a can package without the glass 501, will be described as an example. The laser diode 304 is created by cleaving end faces on both ends of the resonator, and includes a reflection mirror that transmits a part of the laser light. First laser light that is emitted, passing through the front side reflection mirror of the laser light source 300 (hereafter called "front light"), exposes the photosensitive drum 201 to light. Second laser light that is emitted, passing through the rear side reflection mirror (hereafter called "rear light"), is directed to the PD sensor 305 disposed on the opposite surface. The front light and the rear light are laser light which is emitted by a common drive current supply.

In the laser diode 304 used for the laser light source 300, the laser light is emitted from micro emission points (emission portions). Normally in a laser diode 304 used for the image forming apparatus 100, a size of the emission point is several $\mu m^2$. Therefore if even one several micro meter sized foreign matter adheres to the front side emission point 304*a* (first emission portion) of the laser diode 304, the front light is dramatically interrupted, and a desired light quantity may not be acquired on the photosensitive drum 201, or the spot shape may deform. As a result, image quality drops.

If foreign matter adheres to the rear side emission point 304*b* (second emission portion) of the laser diode 304, the light quantity of the rear light emitted to the PD sensor 305 drops. As mentioned above, the light quantity is controlled to be constant so that the quantity of the light received by the PD sensor 305 becomes constant, hence in this case, the front light quantity becomes higher than the desired light quantity.

The laser light emitted from the emission point of the laser diode 304 spreads, and the spot diameter on an optical component in the scanner unit 207 is larger than the size of the emission point. Further, the polygon mirror 403, the imaging lens 404, the reflection mirror 405 and the like are sequentially scanned, hence if dust adheres to these optical components, light quantity gently drops in accordance with the amount of the adhering dust.

On the other hand, as mentioned above, even one foreign matter adhering to the laser diode 304 dramatically changes the light quantity, since the size of the emission point is small. According to the present invention, the light quantity abnormality (abnormal state) of the laser light source 300 is determined by utilizing the difference of the sensitivity to foreign matter between the laser light source 300 (laser diode 304) and other optical components.

<Drum Potential Measurement>

Figure 6:
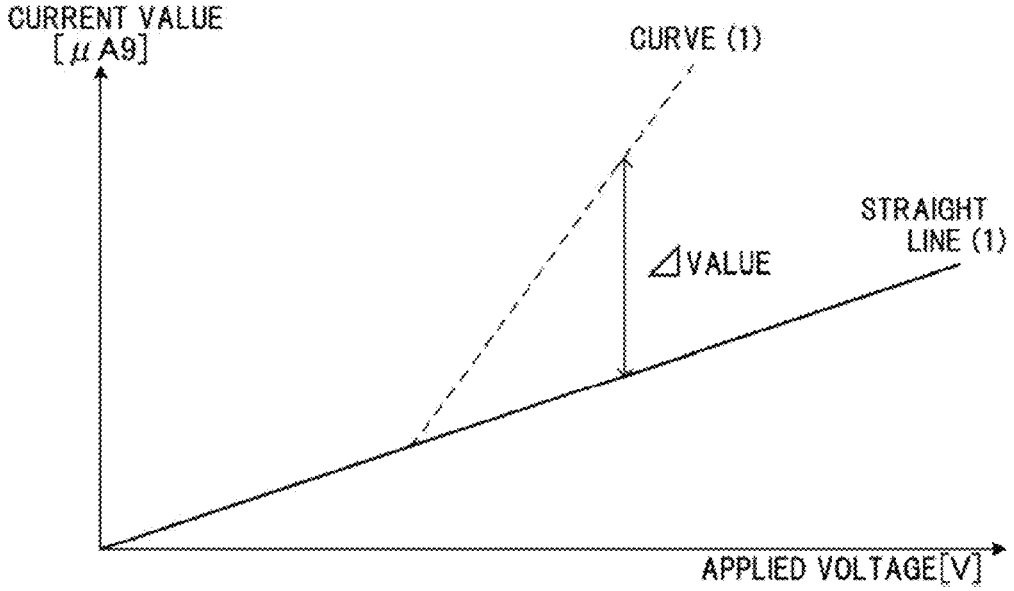
FIG. 6 is a graph depicting a relationship between an applied voltage and a current value.

The measurement of the drum potential will be described in more detail with reference to FIG. 6. FIG. 6 is a graph depicting the relationship between the applied voltage to the transfer roller in a range around the discharge start voltage and the current value flowing through the photosensitive drum. The image forming apparatus of this example has a detection portion (not illustrated) that detects a value on the drum potential (surface potential of the photosensitive drum 201). The "value on the drum potential" and "value on the surface potential of the photosensitive drum" are the surface potential of the photosensitive drum 201 itself, or a value correlated to the surface potential (e.g. voltage value of the voltage applied to the transfer roller for acquiring the surface potential, current value of the current flowing to the photosensitive drum and being acquired (detected) by the voltage applying). As shown in FIG. 6, current in accordance with the voltage applied to the photosensitive drum 201 flows from the transfer roller 204 until discharge starts (straight line (1)). However, once discharge starts between the photosensitive drum 201 and the transfer roller 204, current suddenly begins to flow rapidly and exhibits a curve having an inflection point (curve (1)) as shown in the graph. The voltage at the inflection point is regarded as the discharge start voltage.

Therefore the discharge current that flows between the photosensitive drum 201 and the transfer roller 204 can be calculated using a Δ value generated by subtracting the straight light (1) from the curve (1). Then the voltage when this Δ value reaches a desired current value (e.g. 3 [μA] or −3 [μA]) is determined as the voltage where discharge started. Regarding the discharge characteristics of the photosensitive drum 201, the potential difference required for discharge differs depending on the difference of the environment and the film thickness of the photosensitive drum.

Figure 7:
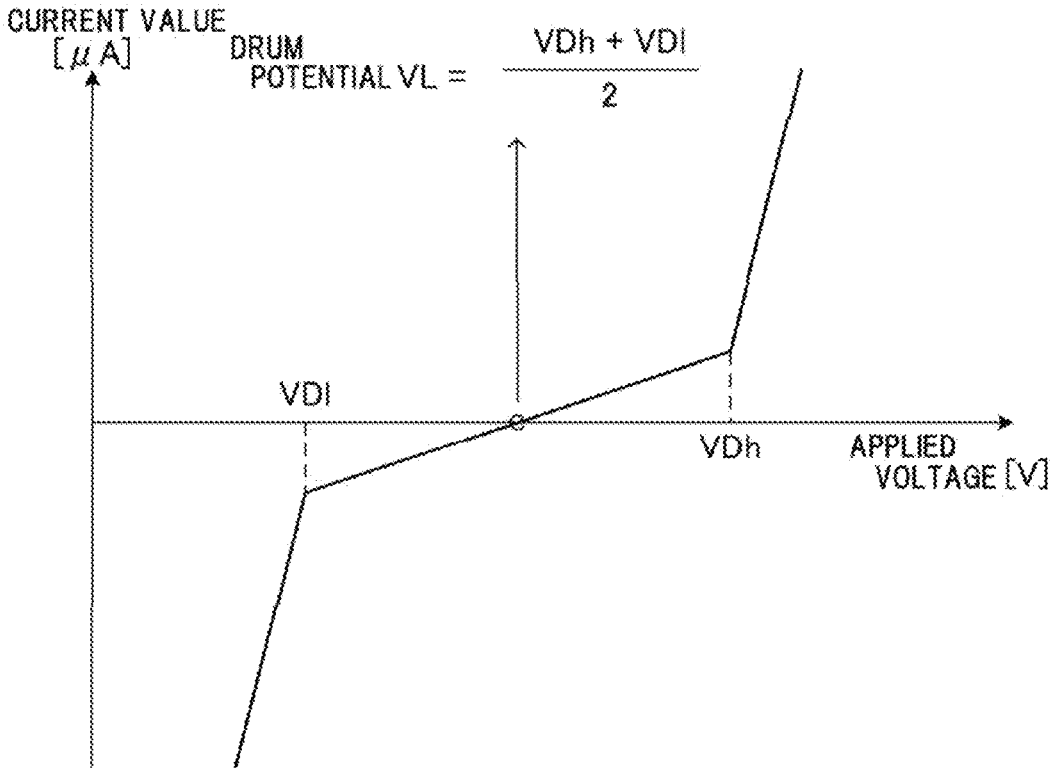
FIG. 7 is a graph depicting calculation of a drum potential.

If the surface property of the transfer roller 204 is equivalent to that of the photosensitive drum 201, then as shown in FIG. 7, the potential difference required for starting the discharge becomes a positive/negative symmetric with respect to the drum potential. This characteristic is well known as the discharge phenomenon. If the transfer roller 204 and the photosensitive drum 201 are regarded as having a plane-plane gap, the discharge characteristic of the photosensitive drum 201 is the same as the discharge characteristic of the plane-plane gap, and the drum potential VL can be determined by the following Expression 1. As shown in FIG. 7, if VDh is the discharge start voltage on the positive side of the surface potential of the photosensitive drum 201, and VD1 is the discharge start voltage on the negative side of the drum potential VL, the drum potential VL is ½ of the total of VDh and VD1. In other words, the drum potential VL can be given by the following Expression 1.

[Math. 1]

$$VL=(VDh+VD1)/2 \qquad \text{Expression 1}$$

The drum potential after emitting the laser light can also be determined in the same manner. Bias around the estimated drum potential after emitting the laser light is applied, and the discharge start voltage VL1 on the negative side of the estimated drum potential after emitting the laser light and the discharge start voltage VLh on the positive side of the estimated drum potential after emitting the laser light, are determined. Then ½ of the total of the determined VL1 and VLh is determined as the drum potential VL. In other words, the drum potential VL after emitting the laser light can be given by the following Expression 2.

[Math. 2]

$$VL=(VLh-VL1)/2 \qquad \text{Expression 2}$$

<Laser Light Quantity Abnormality Determination Method>

Figure 8:
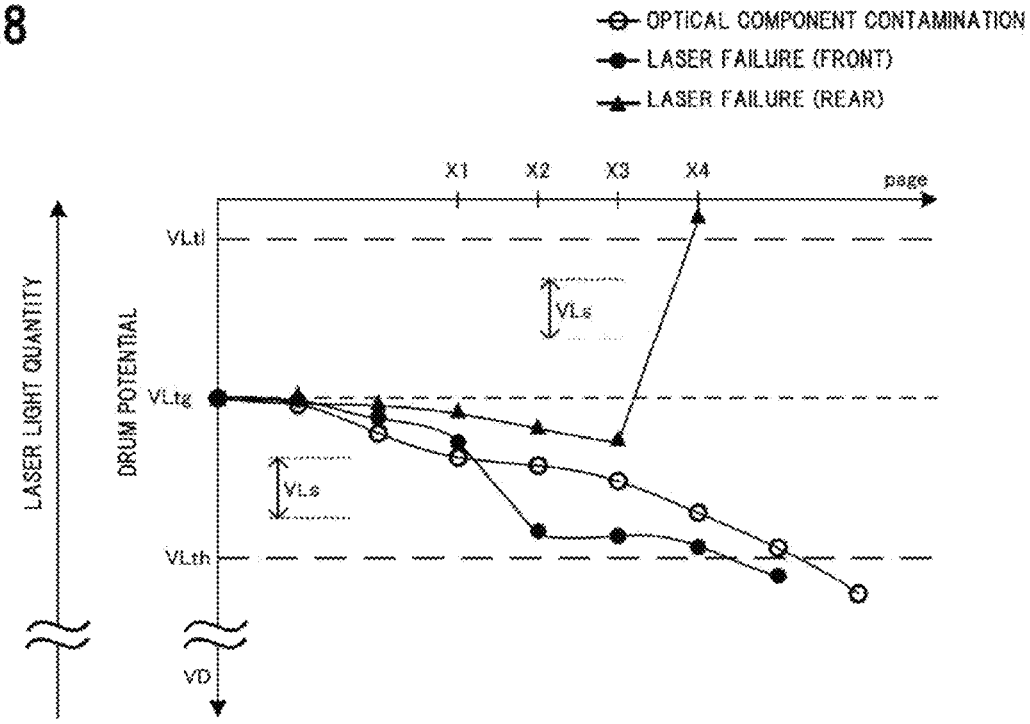
FIG. 8 is a graph depicting a relationship between a drum potential and the laser light quantity after laser irradiation.
Figure 9:
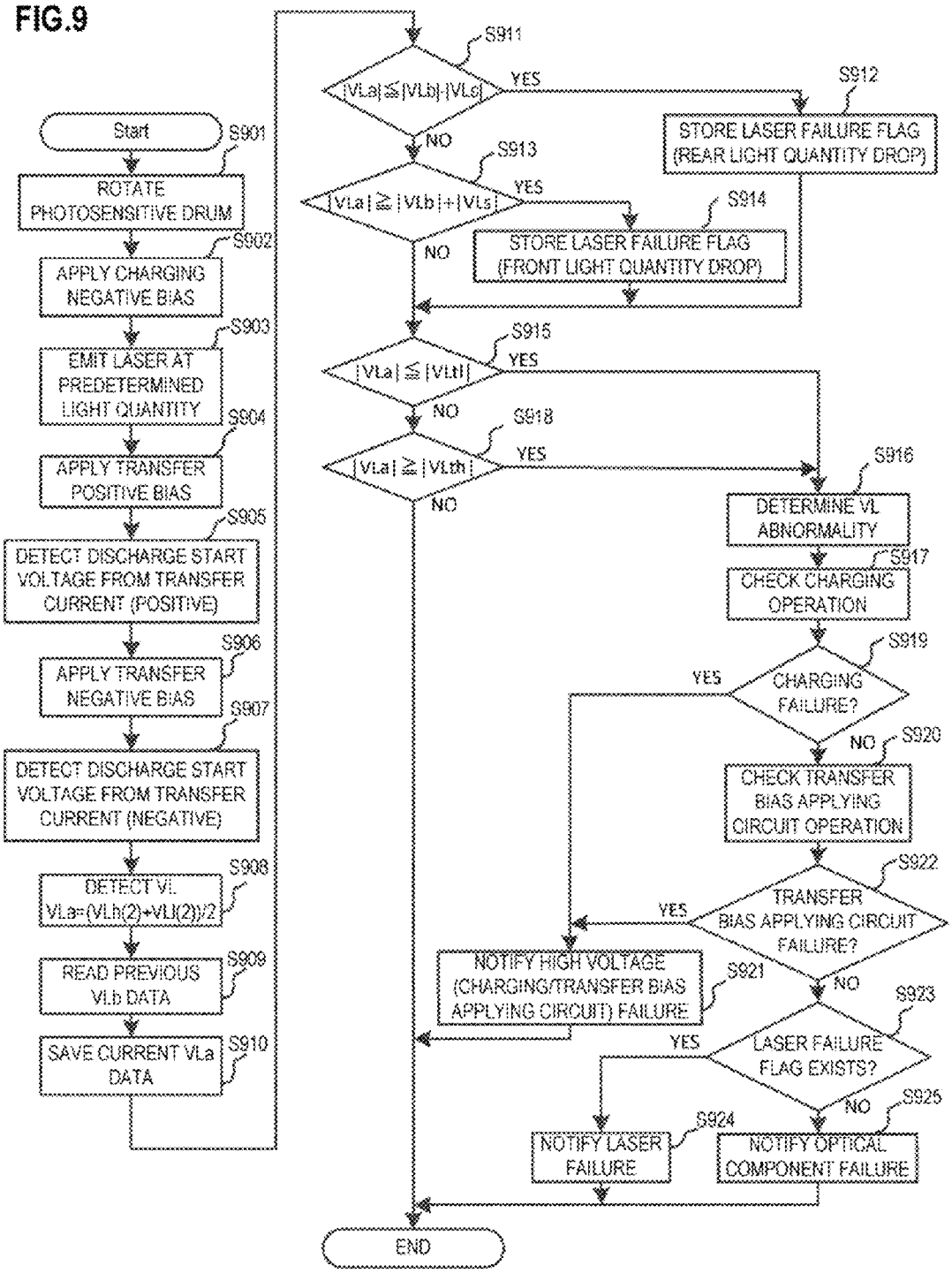
FIG. 9 is a flow chart depicting a laser light quantity abnormality determination sequence according to Example 1.

Now a laser light quantity abnormality determination method according to this example will be described with reference to FIG. 8 and FIG. 9. FIG. 8 is a graph depicting the drum potential and laser light quantity after emitting the laser. First the relationship between the laser light quantity and the drum potential will be described. If the quantity of the laser light that the laser light source 300 emits to the photosensitive drum 201 increases, the drum potential changes from −150 V to −100 V, for example. In other words, the absolute value of the drum potential decreases as the laser light quantity increases.

The abscissa in FIG. 8 indicates a number of printed sheets corresponding to the operating time of the image forming apparatus 100. In this example, a factor that causes a drop in the quantity of the laser light is determined based on the change amount of the drum potential when the drum potential is detected for a plurality of times. In the initial phase of operation, the drum potential when the laser light is emitted at a predetermined light quantity is a desired VLtg.

Here the plot of the white circles in FIG. 8 indicates the state of the drum potential (laser light quantity) that changes by the deposition of foreign matter, such as dust and chemical substance, on the optical components other than the laser diode 304 (contamination of optical components). The plot of the black dots in FIG. 8 indicates the state of the drum potential (laser light quantity) that changes by deposition of foreign matter on the front side emission point 304*a* of the laser diode 304 (laser failure (front)). The plot of the black triangles in FIG. 8 indicates the state of the drum potential (laser light quantity) that changes by deposition of foreign matter on the rear side emission point 304*b* of the laser diode 304 (laser failure (rear)).

As the plot of the white circles in FIG. 8 shows, the drum potential (laser light quantity) gradually drops as the contamination of the optical components increases. As the plot of the black dots shows, the drum potential (laser light quantity) suddenly drops if foreign matter adheres to the front side emission point 304*a* of the laser diode 304. FIG. 8 shows foreign matter adhering to the front side emission point 304*a* when a number of printed sheets is between X1 and X2. As the plot of the black triangles shows, the drum potential (laser light quantity) suddenly increases if foreign matter adheres to the rear side emission point 304*b* of the laser diode 304. FIG. 8 shows foreign matter adhering to the rear side emission point 304*b* when the number of printed sheets is between X3 and X4. In other words, it can be determined that the front side emission point 304*a* is abnormal if the drum potential changes in a negative direction, and that the rear side emission point 304*b* is abnormal if the drum potential changes in a positive direction. The detection timing need not be based on the number of printed sheets, but may be controlled such that detection is performed again at timing X2 when a predetermined time has elapsed from the timing X1.

When laser failure occurs, the absolute value of the change amount of the drum potential in a predetermined period (between X1 and X2 and between X3 and X4 in FIG. 8) is VLs (a predetermined value) or more. In other words, it can be estimated that laser failure occurred if the absolute value of the change amount of the drum potential is VLs or more, that is if the drum potential suddenly changes. On the other hand, if the drum potential gently changes, it can be estimated that failure occurred due to a factor other than laser failure. Thus by measuring the drum potential in accordance with the durability state of the image forming apparatus 100, [the cause of] a laser light quantity abnormality can be estimated.

A control of determining an abnormality of the laser light quantity by the control portion 107 will be further described with reference to FIG. 9. FIG. 9 is a flow chart depicting the laser light quantity abnormality determination sequence according to Example 1. The control portion 107 of the image forming apparatus of this example functions as a determination portion (not illustrated) that determines whether the laser is abnormal, and stores the result as a flag. Voltage is applied to the photosensitive drum 201 from the charging circuit and the transfer circuit (voltage applying portion) via the charging roller 202 and the transfer roller 204. The image forming apparatus of this example also includes a notification portion (not illustrated) that notifies the user about the failure of each component, such as an abnormality of laser light quantity.

First when the laser light quantity abnormality determination sequence is started, the photosensitive drum 201 is rotated (S901), and the photosensitive drum 201 is charged with a charging bias (e.g. −350 V) used for printing (S902). Then the laser light is emitted at a predetermined light quantity (S903), and when the electrostatic latent image formed on the photosensitive drum 201 reaches the transfer roller 204 by the rotation of the photosensitive drum 201, a predetermined transfer positive bias is applied (S904).

With gradually increasing the transfer positive bias, the discharge start voltage VLh on the positive side is determined from the current A that flows from the transfer roller 204 to the ground of the photosensitive drum 201 (S905). In the same manner, a predetermined transfer negative bias is applied (S906), and with gradually decreasing the transfer negative bias, the discharge start voltage VL1 on the negative side is determined from the current A (S907). Using the above mentioned Expression 2 with VLh and VL1 determined in S905 and S907, the drum potential VLa after emitting the laser light is calculated (S908). Then the drum potential VLb after emitting the laser light in the previous measurement, which was stored in the storage portion (not illustrated) of the control portion 107, is read (S909), and VLa of the current measurement result is stored in the storage portion (S910).

Then it is checked whether the absolute value of the current measurement result VLa has dropped from the previous measurement result VLb by a predetermined voltage VLs or more, that is, whether the light quantity emitted to the photosensitive drum 201 has increased by a predetermined value or more (S911). If the absolute value has dropped by VLs or more (YES in S911), the control portion 107 determines that the rear side emission point 304*b* (second emission portion) has an abnormality, and stores the laser light quantity abnormality flag, which indicates a drop in the rear light quantity, in the storage portion (S912). The control portion 107 determines that the rear side emission point 304*b* has an abnormality in the following cases. One is a case when a predetermined quantity of the laser light cannot be emitted from the rear side emission point 304*b* even if a predetermined drive current is supplied, because of occurrence of a failure or end of life of the rear side emission point 304*b* itself. The other is a case when the PD sensor 305 cannot receive a predetermined quantity of the laser light from the rear side emission point 304*b* even if a predetermined drive current is supplied, because of foreign matter adhering to the rear side emission point 304*b*.

If the change amount is smaller than VLs (NO in S911), then it is checked whether the absolute value of the current measurement result VLa has increased from the previous measurement result VLb by a predetermined voltage VLs or more. In other words, it is checked whether the light quantity emitted to the photosensitive drum 201 surface is a predetermined value or less (S913). If the absolute value has increased by VLs or more in the result (YES in S913), the control portion 107 determines that the front side emission point 304*a* (first emission portion) has an abnormality, and stores the laser light quantity abnormality flag, which indicates the drop in front light quantity, in the storage portion (S914). For VLs, potential is determined based on the exposure drop rate when foreign matter adheres to the emission point and is stored in the storage portion in advance. The control portion 107 determines that the front side emission point 304*a* has an abnormality in the following cases. One is a case when a predetermined quantity of the laser light cannot be emitted from the front side emission point 304*a* even if a predetermined drive current is supplied, because of a failure or life of the front side emission point 304*a* itself. The other case is a case when the photosensitive drum 201 cannot be exposed to light at a predetermined light quantity even if a predetermined drive current is supplied, because of foreign matter adhering to the front side emission point 304*a*.

Then it is determined whether the current measurement result VLa is a value within a first predetermined range (VLt1 or more and VLth or less in FIG. 8). In concrete terms, it is determined whether the absolute value of the current measurement result VLa is a predetermined voltage VLt1 or less (S915). If VLt1 or less (YES in S915), it is determined that the absolute value of the drum potential VLa is low, which is a VL abnormality (S916), and the charging operation is checked next (S917). For VLt1, potential is determined based on the exposure amount at which the drum is damaged because the front light quantity is high, and this potential value is stored in the storage portion in advance.

If the absolute value of VLa is higher than VLt1 (NO in S915), it is determined whether the absolute value of the current measurement result VLa is the predetermined voltage VLth or more (S918). If VLa is lower than VLth, the sequence ends (NO in S918), and if VLa is VLth or more (YES in S918), then it is determined that the absolute value of the drum potential is high, which is a VL abnormality (S916), and the charging operation is checked next (S917). For VLth, potential is determined based on the exposure amount at which the printed image quality drops significantly because the front light quantity is low, and this potential value is stored in the storage portion in advance.

Now a process of diagnosis to discern from the factors other than the laser light quantity abnormality related to the abnormalities of exposure amount will be described. First in a state where the laser is not emitted, the photosensitive drum 201 is charged with a charging bias (e.g. −350V) (S917). Then, same controls as those are implemented in S904 to S908 are implemented, and the drum potential is calculated using the above mentioned Expression 1. If the drum potential is a value in a second predetermined range (e.g. −400V or more, −300V or less), it is determined that the charging circuit is operating without problems as the voltage applying portion (NO in S919), and the transfer operation is checked (S920). If the drum potential is a value outside the second predetermined range (YES in S919), on the other hand, the notification portion notifies the high voltage power supply failure (S921).

In the transfer operation check (S920), the photosensitive drum 201 is charged at charging bias 0 V, to check whether the transfer circuit 206 is operating correctly as the voltage applying portion. By sequentially applying a predetermined transfer positive bias and transfer negative bias, it is checked whether the assumed current A, that flows from the transfer roller 204 to the ground of the photosensitive drum 201, is detected respectively. If the detected current is outside a predetermined current range (that is, if the drum potential is outside the second predetermined range) (YES in S922), the notification portion notifies the high voltage power supply failure (S921). If the detected current is within the predetermined range (that is, if the drum potential is within the second predetermined range) (NO in S922), it is determined that the transfer circuit 206 is operating normally and a failure occurred to the scanner unit 207.

Then it is checked whether the laser light quantity abnormality flag is stored in the storage portion (S923), and if stored (YES in S923), the notification portion notifies the user of the laser light quantity abnormality (S924). If the laser light quantity abnormality flag is not stored (NO in S923), on the other hand, the notification portion notifies the user of a failure of an optical component other than the laser diode 304 (S925).

In this example, the previous measurement result is used for VLb, but the same effect can be implemented even if an average value of the measurement results, up to the last measurement time, is used. If the values of VLth and VLt1 are not one value, but change depending on the operating environment and durability of the image forming apparatus 100, the laser light quantity abnormality can be determined with even more accuracy. Here a method of calculating the drum potential, from the discharge start voltage based on the current A flowing from the transfer roller 204 to the ground of the photosensitive drum 201, was described. However, the detection portion may calculate the drum potential based on the current flowing from the charging roller 202 or the developing sleeve 203 to the ground of the photosensitive drum 201.

As described above, in this example, the laser light quantity emitted from the scanner unit 207 is indirectly measured by detecting the drum potential, and the laser light quantity abnormality is detected by checking the change amount of the value related to the drum potential. In other words, in this example it is determined whether the laser diode 304 is abnormal or not based on the change amount of a value related to the surface potential of the photosensitive drum 201. Thereby the laser light quantity abnormality can be detected. Further, the cause of the laser light abnormality can be detected in detail by discerning whether the abnormality is of the front light quantity or the rear light quantity. If service personnel or the like collect the causes of an abnormality and feed it back to design and development, quality of the image forming apparatus can be improved.

If the laser light source 300 generates an abnormal quantity of light that deviates from the desired light quantity, the quality of the print image drops. Moreover, if the front light quantity increases, the photosensitive drum 201 may be damaged. The above mentioned control is an example of determining only a failure, but an abnormality may be determined before a failure occurs if a plurality of thresholds are set for the drum potential. Since the abnormality can be notified to the user before the laser light source 300 completely fails, the downtime of the image forming apparatus 100 due to failure can be reduced.

In this example, a can package without glass 501, where the laser diode 304 is exposed to air, was described as an example, but a can package sealed with glass 501 may be used. In the case of the can package in which the laser diode 304 is sealed by the glass 501, the laser spot diameter on the glass 501 is about 100 μm, for example. In this case, the portion on the glass 501 where the laser light passes through corresponds to the first emission portion of the present invention. In the case of this configuration, the front light quantity suddenly drops when a foreign matter of about 100 μm or larger, adheres to the laser spot on the glass 501.

EXAMPLE 2

Figure 10:
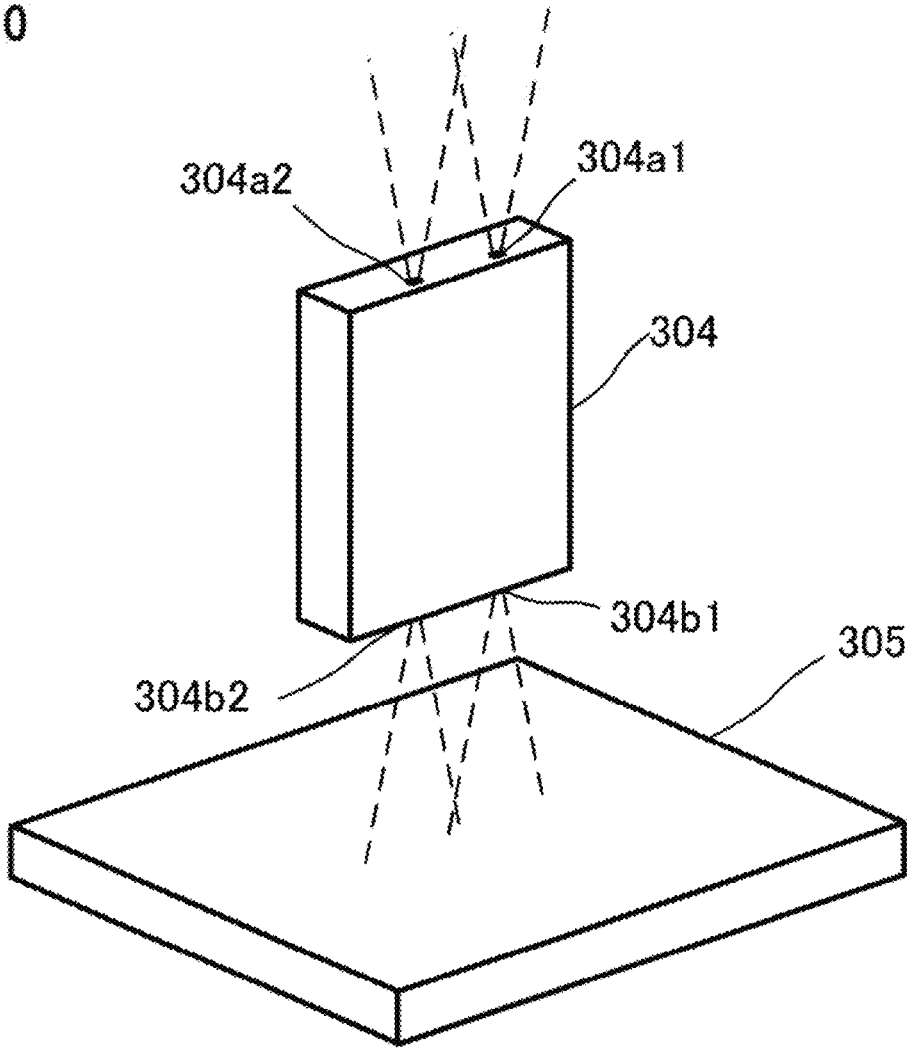
FIG. 10 is a diagram depicting a twin beam laser and a PD sensor of Example 2.
Figure 11:
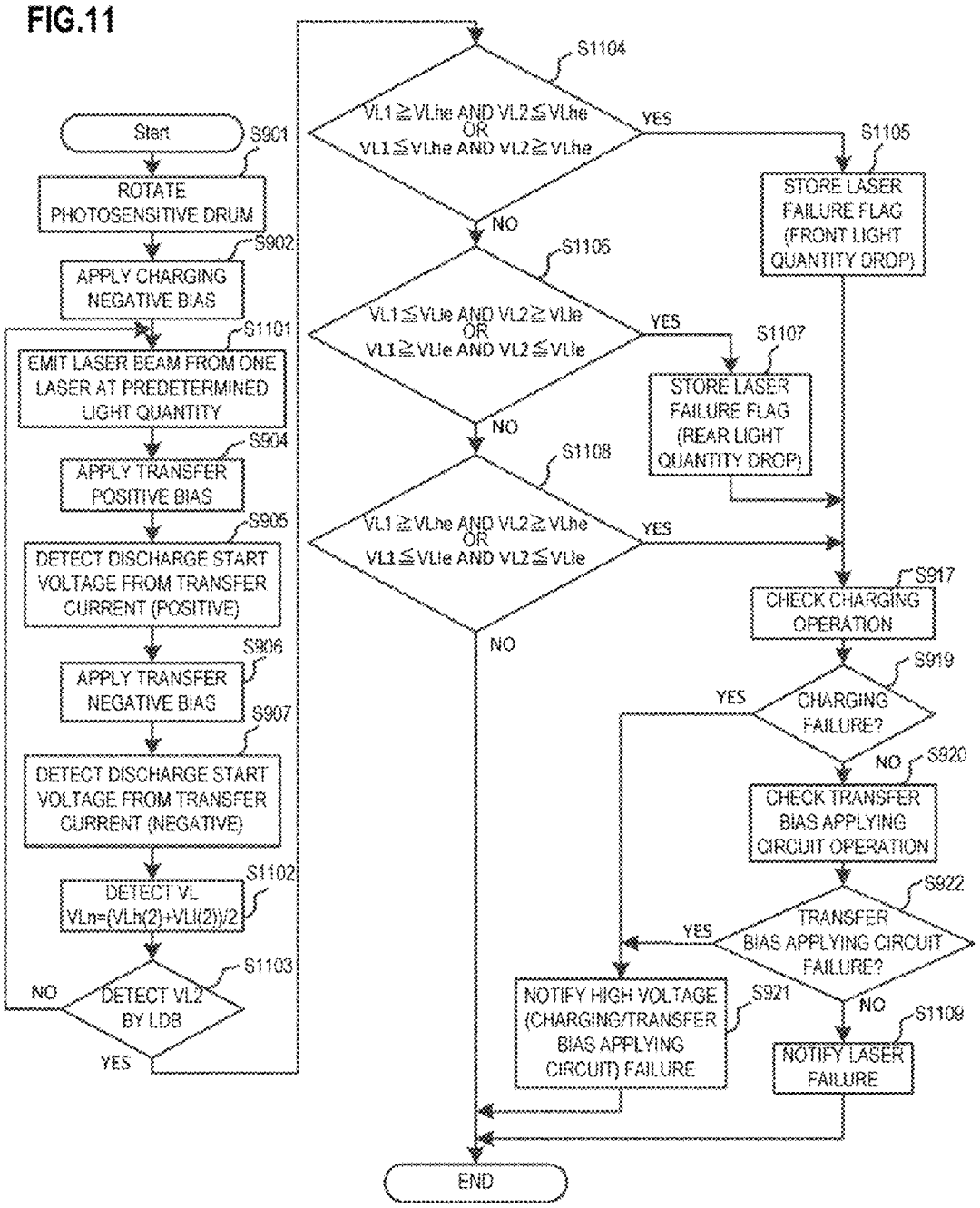
FIG. 11 is a flow chart depicting laser light quantity abnormality determination sequence according to Example 2.

Example 2 will now be described with reference to FIG. 10 and FIG. 11. The general configuration of the image forming apparatus 100 of Example 2 is the same as Example 1, except that a multi-beam laser that can emit a plurality of laser beams from the laser diode 304 is mounted on the laser light source 300. A composing element the same as Example 1 is denoted with a same reference symbol, and description thereof is omitted. In the configuration of Example 2, the laser light quantity abnormality can be determined even with more accuracy than Example 1, by alternately emitting laser beams by the multi-beam laser. In Example 2, a twin-beam laser will be described as an example of the multi-beam laser.

<Configuration of Twin-beam Laser>

The twin-beam laser used in Example 2 will be described first. FIG. 10 is a diagram depicting the twin-beam laser and a PD sensor of Example 2. The twin-beam laser has one laser diode 304 in which two resonators are disposed in parallel. The laser light emitted from a front side emission point 304*a*1 (first emission portion) and a front side emission point 304*a*2 (third emission portion) is directed to the photosensitive drum 201 (photoreceptor). Laser light emitted from a rear side emission point 304*b*1 (second emission portion) and a rear side emission point 304*b*2 (fourth emission portion) are received by the PD sensor 305 (light receiving portion).

The laser light from the front side emission point 304*a*1 and the rear side emission point 304*b*1 is emitted by a supply of a common first drive current. The laser light from the front side emission point 304*a*2 and the rear side emission point 304*b*2 is emitted by a common second drive current supply.

In a standard twin-beam laser used for the image forming apparatus 100, the interval between resonators, that is the emission points, is about 90 μm. Therefore, even if about a several tens μm sized foreign matter adheres to the end face of the reflection mirror of the laser diode 304, it is rare that the foreign matter covers two emission points. Therefore the laser light quantity abnormality is determined using the phenomena in which the light quantity of only one of the two emission points drops when a foreign matter adheres to the other emission point.

<Laser Light Quantity Abnormality Determination Method>

Now a control to determine the laser light quantity abnormality performed by the control portion 107 according to Example 2 will be described with reference to FIG. 11. FIG. 11 is a flow chart depicting the laser light quantity abnormality determination sequence according to Example 2. A step in the flow, the same as Example 1 described in FIG. 9, is denoted with a same reference symbol, and description thereof is omitted.

A laser is emitted from the laser diode A (LDA) as the first light emitting member on one side of the twin-beam at a predetermined light quantity (S1101). Then the drum potential VL1, after emitting the LDA laser, is calculated (S1102). Then it is checked whether VL2 has been detected by the laser diode B (LDB) as the second light emitting member (S1103), and if not, processing returns to S1101, and a laser is emitted from the LDB on the other side of the twin-beam. Then VL2 is calculated in the same manner for the LDB laser as well (S1102).

When calculation of the drum potentials VL1 and VL2 ends, it is checked whether only one of the measurement result VL1 when the LDA laser was emitted, and the measurement result VL2 when the LDB laser was emitted, is VLhe (first predetermined value) or more (S1104). For VLhe, the potential is determined based on the exposure reduction rate when a foreign matter adheres to one of the front side emission points, and this potential value is stored in advance. If only one of VL1 and VL2 is VLhe or more, it is determined that the front side emission point (first emission portion or third emission portion) is abnormal, and a laser light quantity abnormality flag, due to a drop in front light quantity, is stored (S1105).

If not, it is checked whether only one of the drum potentials VL1 and VL2 is VLle (second predetermined value) or less (S1106). If only one of VL1 and VL2 is VLle or less, it is determined that the rear side emission point (second emission portion or fourth emission portion) is abnormal. Then the laser light quantity abnormality flag, due to a drop in rear light quantity, is stored (S1107). Here for VLle, potential is determined based on the exposure increase rate when a foreign matter adheres to one of the rear side emission points, and this potential value is stored in advance.

Then it is checked whether both of the drum potentials VL1 and VL2 are VLhe or more, or VLle or less (S1108). If the result is YES, it is determined that the abnormality is caused by a factor other than the laser light quantity abnormality due to the adhesion of foreign matter on the laser diode 304.

Just like Example 1, if the laser light quantity abnormality flag is stored (if it is determined that one of the first to fourth emission portions is abnormal), the operation of the charging circuit and the transfer circuit is checked to determine whether the abnormality is due to a factor related to an exposure amount abnormality, and not a laser light quantity abnormality. The method for the operation check is the same as Example 1. If it is determined that the charging circuit and the transfer circuit 206 are operating normally (NO in S919 and NO in S922), the notification portion notifies the user of the laser light quantity abnormality (S1109).

Here if the value of VLhe or VLle is not one value but one that changes depending on the operating environment and durability of the image forming apparatus 100, then the laser light quantity abnormality can be determined with even more accuracy. By performing control in this way, laser light quantity abnormality can be accurately determined for the image forming apparatus 100 having a multi-beam laser. Further, the laser light quantity abnormality can be determined with even higher accuracy by combining the control of this example with the control of Example 1. For example, the flow of performing the laser failure notification and optical component failure notification described in S923 to S925 in FIG. 9 may be combined with Example 1.

In this example, the can package without glass 501 was described. But even in the case of a can package sealed by the glass 501, the beam spot diameter on the glass is about 90 μm, and the interval between spots is about several hundred μm, and it is rare that the adhesion of foreign matter covers all beams of the multi-beam laser. Therefore even in the case of the can package sealed by the glass 501, the laser light quantity abnormality can be determined with even higher accuracy than Example 1.

According to the present invention, a factor that drops the quantity of laser light can be determined with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-143577, filed Jul. 11, 2014, which is hereby incorporated by reference herein in its entirety.

What is claimed is:

1. An image forming apparatus, comprising:

a light emitting member that includes a first emission portion to which drive current is supplied and from which first laser light is emitted;

a photoreceptor to which the first laser light is emitted;

a detection portion that detects a value related to a surface potential of the photoreceptor;

a determination portion that determines an abnormality of the light emitting member;

a voltage applying portion that applies voltage to the photoreceptor; and a notification portion that notifies a user that the voltage applying portion is in an abnormal state when a value, detected by the detection portion, related to the surface potential of the photoreceptor to which the first laser light is emitted is a value outside a first predetermined range and when a value, detected by the detection portion, related to the surface potential of the photoreceptor to which the voltage is applied by the voltage applying portion is a value outside a second predetermined range, notifies the user that an optical component other than the light emitting member is in an abnormal state when a value, detected by the detection portion, related to the surface potential of the photoreceptor to which the first laser light is emitted is a value outside a first predetermined range and when a value, detected by the detection portion, related to the surface potential of the photoreceptor to which the voltage is applied by the voltage applying portion is a value within a second predetermined range and the determination portion does not determine that the light emitting member is in an abnormal state, and notifies the user that the light emitting member is in the abnormal state when a value, detected by the detection portion, related to the surface potential of the photoreceptor to which the first laser light is emitted is a value outside a first predetermined range and when a value, detected by the detection portion, related to the surface potential of the photoreceptor to which voltage is applied by the voltage applying portion is a value within a second predetermined range and when the determination portion determines that the light emitting element is in the abnormal state, wherein the detection portion detects, a plurality of times, a value related to the surface potential of a portion of the photoreceptor to which the first laser light is emitted, and the determination portion determines whether the light emitting member is in the abnormal state, based on a change amount of the value related to the surface potential detected by the detection portion.

2. The image forming apparatus according to claim 1, wherein the light emitting member has a second emission portion to which drive current, which is common with the drive current, is supplied and from which second laser light is emitted, the image forming apparatus further comprising:

a light receiving portion that receives the second laser light; and a light quantity control portion that controls the light quantity of the first laser light emitted to the photoreceptor, based on the light quantity of the second laser light received by the light receiving portion, and wherein the determination portion determines whether the first emission portion is in an abnormal state, and whether the second emission portion is in an abnormal state, based on whether the change amount has a positive value or negative value.

3. The image forming apparatus according to claim 1, wherein the determination portion determines that the light emitting member is in the abnormal state when the absolute value of the change amount is a predetermined value or more.

4. The image forming apparatus according to claim 2, wherein the determination portion determines that the first emission portion is in the abnormal state when the absolute value of the change amount is the predetermined value or more and the change amount has a negative value, and determines that the second emission portion is in the abnormal state when the absolute value of the change amount is the predetermined value or more and the change amount has a positive value.

5. The image forming apparatus according to claim 1, wherein the detection portion acquires a discharge start voltage of the photoreceptor, as the value related to the surface potential of the photoreceptor, based on a current value of current which flows when voltage is applied to the photoreceptor by the voltage applying portion, and detects the surface potential of the photoreceptor, based on the acquired discharge start voltage.

6. The image forming apparatus according to claim 1, wherein the detection portion detects a value related to the surface potential of a portion of the photoreceptor to which the first laser light is emitted, and again detects a value related to the surface potential of the portion of the photoreceptor to which the first laser light is emitted, after a predetermined number of images is formed.

7. The image forming apparatus according to claim 1, wherein the detection portion detects a value related to the surface potential of a portion of the photoreceptor to which the first laser light is emitted, and again detects a value related to the surface potential of the portion of the photoreceptor to which the first laser light is emitted, after a predetermined time elapses.

8. The image forming apparatus according to claim 1, wherein the detection portion that detects a value related to the surface potential of the photoreceptor includes:

a voltage applying portion that applies voltage to the photoreceptor; and a current detection portion that detects a current value of current which flows through the photoreceptor when the voltage applying portion applies voltage, and the determination portion determines whether the light emitting member is in the abnormal state, using a detected current value which the current detection portion has detected, as a value related to the surface potential of the photoreceptor, or surface potential of the photoreceptor acquired based on an applied voltage value which the voltage applying portion has applied and a detected current value which the current detection portion has detected.

9. An image forming apparatus, comprising:

a first light emitting member that includes a first emission portion emitting first laser light and a second emission portion emitting second laser light, and that emits the first laser light and the second laser light by supply of a common first drive current;

a second light emitting member that includes a third emission portion emitting third laser light and a fourth emission portion emitting fourth laser light, and that emits the third laser light and the fourth laser light by supply of a common second drive current;

a photoreceptor to which the first laser light and the third laser light are emitted;

a light receiving portion that receives the second laser light and the fourth laser light;

a light quantity control portion that controls a light quantity of the first laser light, which is emitted to the photoreceptor, based on the light quantity of the second laser light received by the light receiving portion, and controls a light quantity of the third laser light, which is emitted to the photoreceptor, based on the light quantity of the fourth laser light received by the light receiving portion;

a detection portion that detects a value on a first surface potential of a portion of the photoreceptor to which the first laser light is emitted, and a value on a second surface potential of a portion of the photoreceptor to which the third laser light is emitted; and a determination portion that determines an abnormality of the light emitting member, wherein the determination portion determines that the light emitting member is in an abnormal state when only one of the value on the first surface potential and the value on the second surface potential, detected by the detection portion, is a first predetermined value or more, and also determines that the light emitting member is in an abnormal state when only one of the value on the first surface potential and the value on the second surface potential, detected by the detection portion, is a second predetermined value or less.

10. The image forming apparatus according to claim 9, further comprising:

a voltage applying portion that applies voltage to the photoreceptor; and a notification portion that notifies a user that the voltage applying portion is in an abnormal state when the determination portion determines that any of the first to fourth emission portions is in the abnormal state, and when a value, detected by the detection portion, related to the surface potential of the photoreceptor to which the voltage is applied by the voltage applying portion is a value outside a second predetermined range; and notifies the user that the light emitting member is in an abnormal state when the determination portion determines that any of the first to fourth emission portions is in the abnormal state and when a value, detected by the detection portion, related to the surface potential of the photoreceptor to which the voltage is applied by the voltage applying portion, is a value within the second predetermined range.

11. The image forming apparatus according to claim 9, further comprising:

a storage portion that stores the first predetermined value and the second predetermined value in advance.

12. The image forming apparatus according to claim 10, wherein the detection portion acquires a discharge start voltage of the photoreceptor, as the value related to the surface potential of the photoreceptor, based on a current value of current which flows when voltage is applied to the photoreceptor by the voltage applying portion, and detects the surface potential of the photoreceptor, based on the acquired discharge start voltage.

* * * * *